US008342424B2

(12) United States Patent
Suzuki et al.

(10) Patent No.: US 8,342,424 B2
(45) Date of Patent: Jan. 1, 2013

(54) FUEL INJECTION APPARATUS

(75) Inventors: Takashi Suzuki, Chiryu (JP); Kouichi Mochizuki, Anjo (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 746 days.

(21) Appl. No.: 12/499,259

(22) Filed: Jul. 8, 2009

(65) Prior Publication Data

US 2010/0006676 A1 Jan. 14, 2010

(30) Foreign Application Priority Data

Jul. 14, 2008 (JP) ..... 2008-182372

(51) Int. Cl.
*B05B 1/08* (2006.01)

(52) U.S. Cl. ..... 239/102.2; 239/533.2; 239/88; 251/129.06; 123/467

(58) Field of Classification Search .. 239/533.2–533.12, 239/600, 102.2, 88; 123/467, 446, 447; 251/129.06
See application file for complete search history.

(56) References Cited

U.S. PATENT DOCUMENTS

| | | | | |
|---|---|---|---|---|
| 5,287,838 | A * | 2/1994 | Wells | 123/467 |
| 6,634,336 | B1 * | 10/2003 | Kropp | 123/467 |
| 6,802,298 | B2 * | 10/2004 | Yoshimura et al. | 123/467 |
| 7,464,882 | B2 * | 12/2008 | Kanamori | 239/96 |

FOREIGN PATENT DOCUMENTS

| | | |
|---|---|---|
| JP | 11-050930 | 2/1999 |
| JP | 2006-214317 | 8/2006 |

OTHER PUBLICATIONS

Japanese Office Action dated Jun. 21, 2010, issued in corresponding Japanese Application No. 2008-182372, with English translation.

* cited by examiner

*Primary Examiner* — Dinh Q Nguyen
(74) *Attorney, Agent, or Firm* — Nixon & Vanderhye PC

(57) ABSTRACT

A needle is received in a nozzle body and is adapted to reciprocate relative to an injection hole to open and close the injection hole. A pressure chamber receives the fuel and exerts a pressure against the needle in an opening direction away from the injection hole upon increasing of the pressure of the fuel in the pressure chamber. A damper arrangement is actuated upon increasing of the pressure in the pressure chamber to alleviate a change in the pressure in the pressure chamber. A pressurizing piston reciprocates to increase and decrease the pressure of the fuel in the pressure chamber.

3 Claims, 6 Drawing Sheets

FUEL INJECTION APPARATUS

CROSS REFERENCE TO RELATED APPLICATION

This application is based on and incorporates herein by reference Japanese Patent Application No. 2008-182372 filed on Jul. 14, 2008.

BACKGROUND OF THE INVENTION

1. Field of the Invention

The present invention relates to a fuel injection apparatus.

2. Description of Related Art

A fuel injection apparatus, which injects fuel into a combustion chamber of an internal combustion engine, is known.

For example, Japanese Unexamined Patent Publication No. 2006-214317A teaches a fuel injection apparatus, which has a pressure control arrangement. The pressure control arrangement includes a pressure chamber, which applies a pressure against a needle to lift the needle away from injection holes to open the same for injecting fuel when a piston is driven to pressurize the fuel in the pressure chamber. This type of fuel injection apparatus is developed to meet a demand for promoting atomization of fuel by increasing a fuel injection pressure to a higher pressure in a direct fuel injection internal combustion engine, in which the fuel is directly injected in each cylinder.

In the fuel injection apparatus of Japanese Unexamined Patent Publication No. 2006-214317A, an actuator (e.g., a piezoelectric driver), which exerts a large drive force, is used to displace the piston to increase the pressure of the pressure chamber relative to the pressure of the fuel passage, which corresponds to the injection pressure of fuel, so that the injection quantity of fuel is controlled under the high injection pressure condition. However, the above technique of lifting the needle by the pressurized fuel poses the following disadvantage. That is, when the needle is lifted, a volume of the pressure chamber is increased to cause a reduction in the pressure of the pressure chamber. When the pressure of the pressure chamber is reduced, the lifting speed of the needle is immediately, disadvantageously reduced.

In such a case, the lifting speed of the needle right after the opening of the injection holes cannot be maintained. Therefore, the pressure of the pressure chamber cannot be maintained at a required minimum pressure (hereinafter, referred to as a required valve opening pressure), which is required to open the injection holes by lifting the needle against an urging force (e.g., the pressure in the fuel passage) applied toward the injection holes. As a result, the needle is gradually moved downward toward the injection holes to close the injection holes. When this state is encountered, the injection holes are soon closed by the needle to terminate the fuel injection although an injection signal for executing the fuel injection is kept supplied to the actuator. Thus, it is difficult to control the injection quantity of fuel according to the injection signal. Thereby in the previously proposed fuel injection apparatus described above, the stable valve opening operational response may not be obtained.

SUMMARY OF THE INVENTION

Thus, it is an objective of the present invention to provide a fuel injection apparatus, which substantially maintains a lifting speed of a needle at the time of executing a valve opening operation and thereby to control fuel injection in a manner that implements stable operational response.

To achieve the objective of the present invention, there is provided a fuel injection apparatus, which includes a nozzle body, a needle, a pressure control arrangement and a pressurizing means. The nozzle body includes a fuel passage and an injection hole. Fuel is supplied from an external fuel source to the fuel passage. The injection hole is located on a downstream side of the fuel passage and is adapted to inject the fuel outside of the nozzle body. The needle is received in the nozzle body and is adapted to reciprocate relative to the injection hole in a reciprocating direction to open and close the injection hole. The pressure control arrangement includes a pressure chamber and a damper. The pressure chamber receives the fuel and exerts a pressure against the needle in an opening direction away from the injection hole upon increasing of the pressure of the fuel in the pressure chamber. The damper is actuated upon increasing of the pressure in the pressure chamber to alleviate a change in the pressure in the pressure chamber. The pressurizing means is for increasing the pressure of the fuel in the pressure chamber.

To achieve the objective of the present invention, there is also provided a fuel injection apparatus, which includes a nozzle body, a needle, a first urging member, a pressure control arrangement, a pressurizing piston, a second urging member and a piezoelectric driver. The nozzle body includes a fuel passage and an injection hole. Fuel is supplied from an external fuel source to the fuel passage. The injection hole is located on a downstream side of the fuel passage and is adapted to inject the fuel outside of the nozzle body. The needle is received in the nozzle body and is adapted to reciprocate relative to the injection hole in a reciprocating direction to open and close the injection hole. The first urging member has one end, which is installed to an inner wall of the nozzle body, and the other end, which urges the needle in a closing direction toward the injection hole. The pressure control arrangement includes a pressure chamber and a damper. The pressure chamber receives the fuel and exerts a pressure against the needle in an opening direction away from the injection hole against an urging force of the first urging member upon increasing of the pressure of the fuel in the pressure chamber. The damper is actuated upon increasing of the pressure in the pressure chamber to increase a volume of the pressure chamber. The pressurizing piston is received in the nozzle body and is adapted to reciprocate in the nozzle body to increase and decrease the pressure in the pressure chamber. The second urging member urges the pressurizing piston in a decreasing direction to decrease the pressure of the pressure chamber. The piezoelectric driver has one end fixed to the nozzle body and is extendable in response to an amount of electric power supply to the piezoelectric driver to urge the pressurizing piston against an urging force of the second urging member in an increasing direction, which is opposite from the decreasing direction, to increase the pressure of the pressure chamber.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
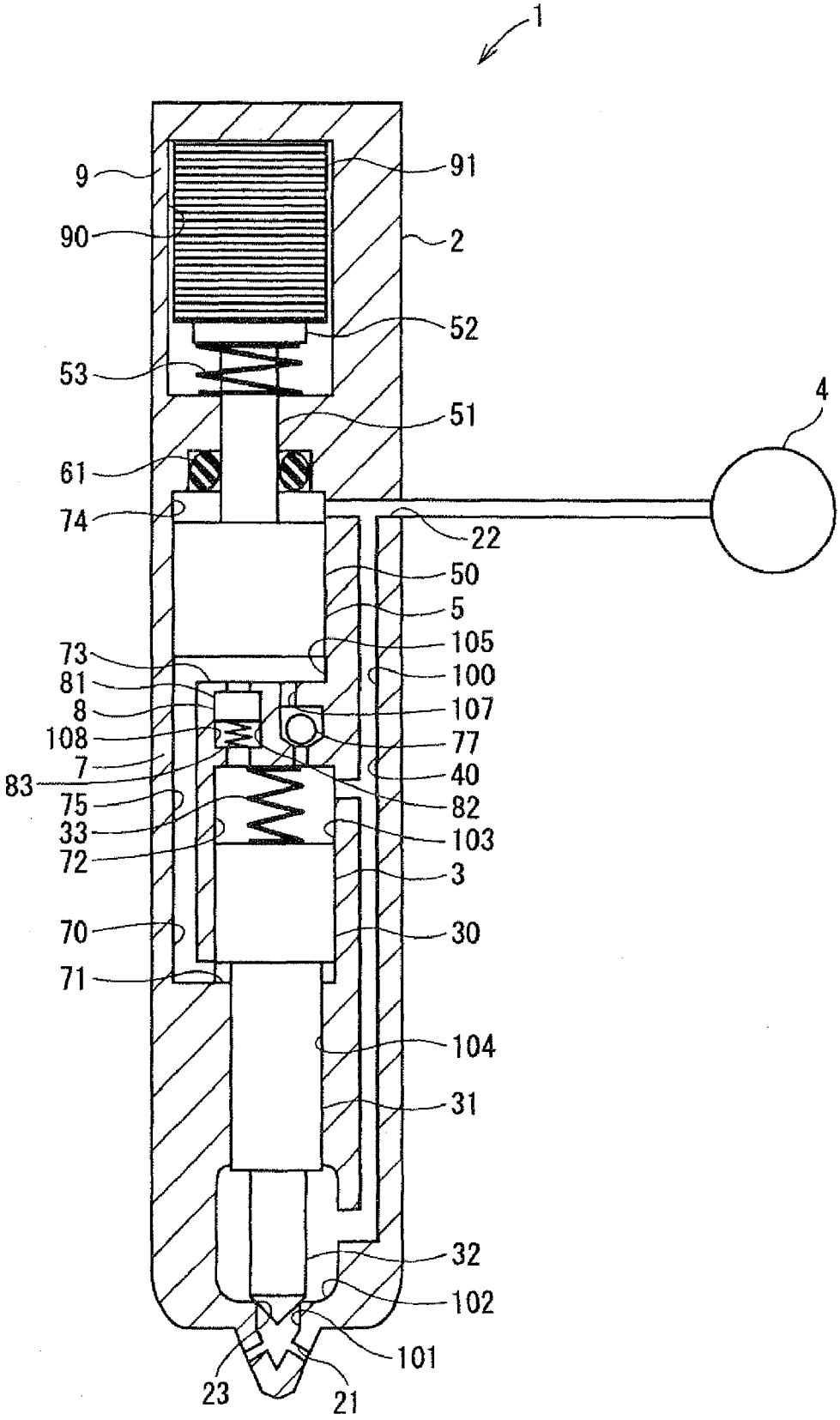
FIG. 1 is a longitudinal cross-sectional view of a fuel injection apparatus according to a first embodiment of the present invention held in a state where injection holes of the fuel injection apparatus are closed.

FIG. 1 shows one of fuel injection apparatuses 1 according to a first embodiment of the present invention. The fuel injection apparatuses 1 are respectively installed to cylinders of, for example, a diesel engine (an internal combustion engine) to inject high pressure fuel, which is accumulated in a common rail, into the cylinders. Each fuel injection apparatus 1 includes a nozzle body 2, a needle 3, a pressurizing piston 5 and a drive arrangement 9. The nozzle body 2 is configured into a tubular body and has injection holes 21 at one end portion thereof. The injection holes 21 are communicated with the interior and the exterior of the nozzle body 2. Furthermore, the nozzle body 2 forms a fuel chamber 101 in the interior thereof. The fuel chamber 101 is formed as a space that is communicated with the injection holes 21.

A fuel passage 100 is formed in the interior of the nozzle body 2. The fuel passage 100 is communicated with an accumulator (an external fuel source) 4 through a flow inlet 22, which is formed in the nozzle body 2. The accumulator 4 is, for example, a common rail provided to the diesel engine. The fuel passage 100 is supplied with the fuel, which has the pressure that is substantially the same as that of the interior of the accumulator 4. The fuel chamber 101 forms a part of the fuel passage 100.

In the interior of the nozzle body 2, the fuel passage 100 is communicated with a fuel well 102, a needle chamber 103, a slide chamber 104 and a piston chamber 105. The fuel well 102 is communicated with the fuel chamber 101. The needle chamber 103 receives a large diameter portion 30 of the needle 3. The slide chamber 104 receives a small diameter portion 31 of the needle 3. The piston chamber 105 receives a piston 50 of the pressurizing piston 5. The needle chamber 103 is communicated with the fuel well 102 through the slide chamber 104. The needle 3 has the large diameter portion 30, the small diameter portion 31 and a valve portion 32. The large diameter portion 30 and the small diameter portion 31 are configured into generally cylindrical bodies, respectively, and the large diameter portion 30 has an outer diameter larger than that of the small diameter portion 31. The valve portion 32 has an outer diameter smaller than that of the small diameter portion 31 and extends from the small diameter portion 31 on a side opposite from the large diameter portion 30. The needle 3 is placed in the interior of the nozzle body 2 as follows. That is, the large diameter portion 30 slides along an inner peripheral wall of the needle chamber 103, and the small diameter portion 31 slides along an inner peripheral wall of the slide chamber 104. Furthermore, the valve portion 32 reciprocates in the interior of the fuel well 102. The large diameter portion 30 of the needle 3 is urged toward the injection holes 21 by a spring 33, which serves as a first urging member and is provided between the large diameter portion 30 and an opposed inner wall of the needle chamber 103, which is located on an axial side opposite from the injection holes 21. Furthermore, in FIG. 1, the valve portion 32 is engaged with, i.e., is seated against a valve seat 23, which is formed between the fuel chamber 101 and the fuel well 102 in the nozzle body 2, to disconnect the fuel passage 100 in the interior of the nozzle body 2 from the outside of the nozzle body 2.

The pressurizing piston 5, which serves as a pressurizing means, has a rod portion 51 and a flange portion 52. The rod portion 51 extends from the piston 50, which slides along the inner peripheral wall of the piston chamber 105, on the side of the piston 50, which is opposite from the injection holes 21. The flange portion 52 is connected to the rod portion 51 on the side opposite from the piston 50. The rod portion 51 extends through a wall of the nozzle body 2 into the interior of the driver receiving chamber 90, which is formed in the nozzle body 2. A diameter of the piston chamber 105 is reduced at an end portion thereof located on the side opposite from the injection holes 21. A rubber seal 61 is provided to seal between the rod portion 51 and the inner wall of the nozzle body 2, which forms the end portion of the piston chamber 105 on the side opposite from the injection holes 21. The rubber seal 61 limits a flow of the fuel, which is filled in the interior of the piston chamber 105, toward the driver receiving chamber 90.

One end of a piezoelectric driver (piezoelectric stack actuator) 91 is installed to an end surface of the driver receiving chamber 90, which is opposite from the injection holes 21, to form the drive arrangement 9. When the electric power is supplied from an electric power source (not shown) to the piezoelectric driver 91, the other end of the piezoelectric driver 91 is extended toward the pressurizing piston 5. The pressurizing piston 5 is urged away from the injection holes 21 toward the piezoelectric driver 91 by a spring 53, which contacts the flange portion 52 and serves as a second urging member and is provided to the inner wall of the driver receiving chamber 90, which is opposed to the piezoelectric driver 91.

The needle chamber 103 has a pressure control chamber 71 and a first back pressure chamber 72. The pressure control chamber 71 is located on the one axial side of the large diameter portion 30 where the injection holes 21 are located. The first back pressure chamber 72 is located on the other axial side of the large diameter portion 30, which is opposite from the pressure control chamber 71. The piston chamber 105 has a pressurizing chamber 73 and a second back pressure chamber 74. The pressurizing chamber 73 is located on one axial side of the piston 50 where the injection holes 21 are located. The second back pressure chamber 74 is located on the other axial side of the piston 50, which is opposite from the pressurizing chamber 73. The pressure control chamber 71 and the pressurizing chamber 73 are communicated with each other through a pressure chamber communication passage 75, which is formed in the inner wall of the nozzle body 2 independently from the fuel passage 100. The pressure control chamber 71, the pressurizing chamber 73 and the pressure chamber communication passage 75 form a pressure chamber 70 in a pressure control arrangement 7. In the present embodiment, the pressure control arrangement 7 forms a part of the nozzle body 2. The first back pressure chamber 72 and the second back pressure chamber 74 of the pressure control arrangement 7 form a supply pressure space 40 in corporation with the fuel passage 100 and the fuel well 102. In this way, the fuel, which is filled in the interior of the nozzle body 2, satisfies the following state. That is, the pressure in the supply pressure space 40 is equal to the pressure of the fuel in the accumulator 4 and the fuel injection pressure. Furthermore, the pressure in the pressure chamber 70 is equal to or higher than the pressure in the supply pressure space 40.

The supply pressure space 40 and the pressure chamber 70 are communicated with each other through a communication passage 107, which connects between the first back pressure chamber 72 and the pressurizing chamber 73. Furthermore, a check valve 77 is provided in the communication passage 107. The check valve 77 limits the leakage of the pressurized fuel in the pressurizing chamber 73 to the first back pressure chamber 72 through the communication passage 107. A damper passage 108 is formed between the first back pressure chamber 72 and the pressurizing chamber 73 in parallel with the communication passage 107. The damper passage 108 has a damper piston 81 and a damper chamber 82. The damper piston 81 is slidably received in the damper chamber 82 to reciprocate between the pressurizing chamber 73 side and the first back pressure chamber 72 side. A damper spring 83 is received in the damper chamber 82 such that one end of the damper spring 83 is installed to an inner wall of the damper chamber 82 located on the first back pressure chamber 72 side. The damper spring 83 urges the damper piston 81 toward the pressurizing chamber 73. The damper piston 81 and the damper spring 83, which are provided in the damper chamber 82, form a damper arrangement 8, which serves as a damper of the present invention. Furthermore, the damper chamber 82, the damper passage 108 and the first back pressure chamber 72 side space of the communication passage 107 are included in the supply pressure space 40. Furthermore, the damper chamber 82, the damper passage 108 and the pressurizing chamber 73 side space of the communication passage 107 are included in the pressure chamber 70.

Next, an operation of the fuel injection apparatus 1 will be described with reference to FIGS. 1 and 2.

As shown in FIG. 1, when the piezoelectric driver 91 is not electrically charged, the piezoelectric driver 91 is contracted. When the piezoelectric driver 91 is contracted in the state where the fuel is filled in the pressure chamber 70 and the supply pressure space 40 having the fuel passage 100, the pressure in the pressure chamber 70 and the pressure in the supply pressure space 40 are equal to the pressure in the fuel passage 100. At this time, the valve portion 32 of the needle 3 is seated against the valve seat 23 by the urging force of the spring 33. Therefore, the communication between the fuel well 102 and the fuel chamber 101 is disconnected, and thereby the fuel is not injected through the injection holes 21.

Figure 2:
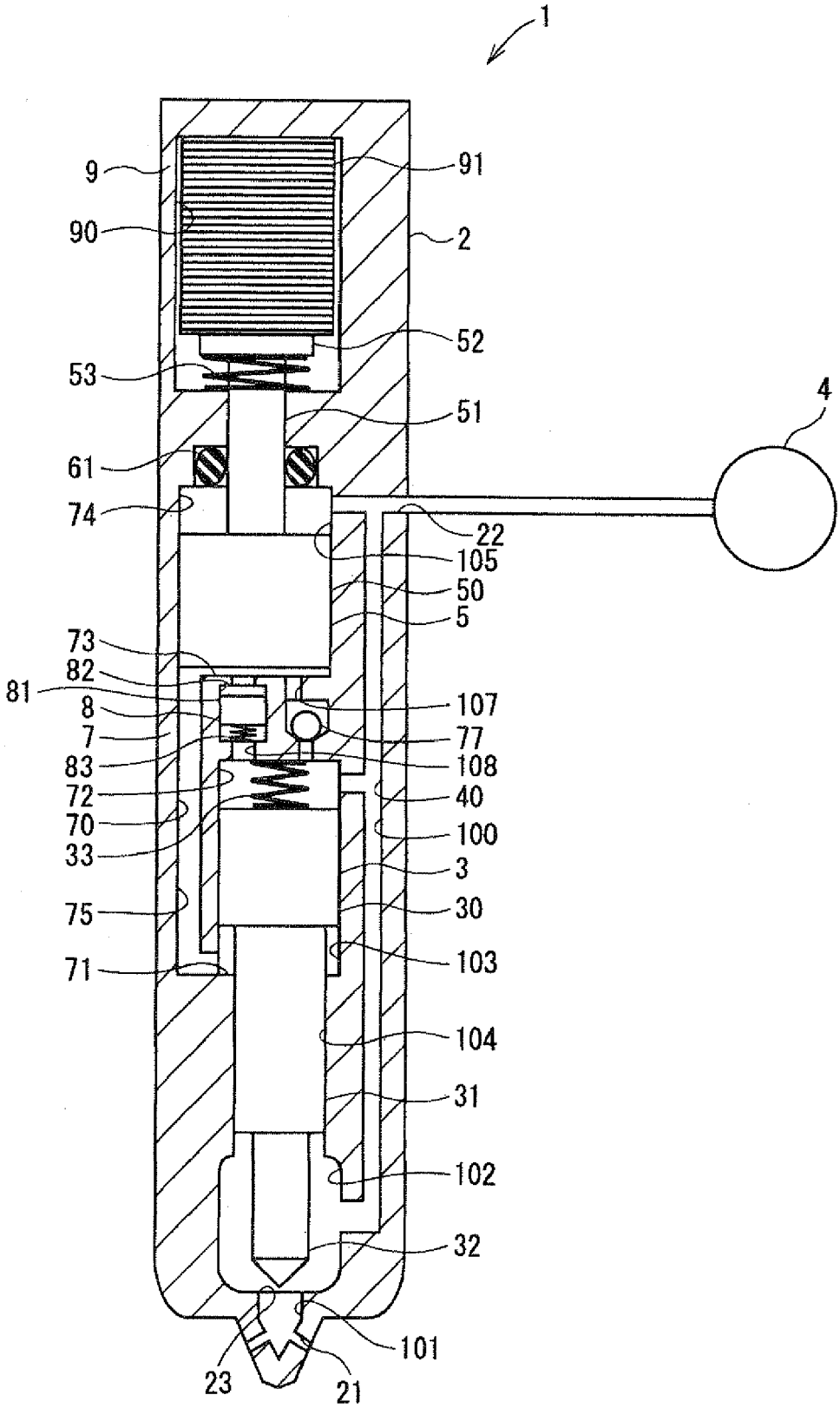
FIG. 2 is a longitudinal cross-sectional view of the fuel injection apparatus shown in FIG. 1 held in another state where the injection holes of the fuel injection apparatus are opened.

As shown in FIG. 2, when the electric charging of the piezoelectric driver 91 starts, the piezoelectric driver 91 is axially extended to urge the flange portion 52 of the pressurizing piston 5 toward the injection holes 21 against the urging force of the spring 53. In this way, in the pressure control arrangement 7, the piston 50 is urged through the rod portion 51 in a decreasing direction for decreasing the volume of the pressurizing chamber 73. Therefore, the fuel in the pressurizing chamber 73 is pressurized. When the fuel in the pressurizing chamber 73 is pressurized, the pressure of the fuel in the pressure control chamber 71, which is communicated with the pressurizing chamber 73 through the pressure chamber communication passage 75, is increased. The pressure in the pressure control chamber 71 acts on the needle 3 and each wall surface of the needle chamber 103 of the nozzle body 2. Therefore, when the pressure of the fuel in the pressure control chamber 71 is increased, the large diameter portion 30 of the needle 3 is axially urged in a direction opposite from the valve seat 23. Therefore, the valve portion 32 of the needle 3 is lifted away from the valve seat 23. In this way, the fuel in the first back pressure chamber 72 is supplied to the fuel well 102 through the fuel passage 100. Then, when the valve portion 32 of the needle 3 is lifted away from the valve seat 23, the fuel well 102 and the fuel chamber 101 are communicated with each other. Thus, the fuel is injected from the injection holes 21.

Furthermore, in the state where the fuel in the pressurizing chamber 73 is pressurized, the fuel in the portion of the communication passage 107, which is included in the pressure chamber 70 and is located on the pressurizing chamber 73 side of the check valve 77, and the fuel in the portion of the damper passage 108, which is included in the pressure chamber 70 and is located on the pressurizing chamber 73 side of the damper piston 81, are also increased. The pressure of the pressure chamber 70 is applied to the check valve 77, the damper piston 81 and the wall surfaces of the nozzle body 2, which form the communication passage 107 and the damper passage 108. In this way, the check valve 77 is urged toward the first back pressure chamber 72 to interrupt the communication through the communication passage 107 between the pressurizing chamber 73 and the first back pressure chamber 72. Also, the damper piston 81 is urged by the pressurized fuel in the pressure chamber 70 toward the back pressure chamber 72 side against the urging force of the damper spring 83 that is placed at the first back pressure chamber 72 side in the damper chamber 82 and acts toward the pressurizing chamber 73 side. Therefore, before the upward movement of the needle 3 away from the injection holes 21, a pressure difference is developed between the fuel in the pressure chamber 70 and the fuel in the supply pressure space 40 due the interruption of the communication by the check valve 77. The amount of reduction in the volume of the pressure chamber 70 caused by the compression by the piston 50 becomes smaller due to cancellation by the increase in the volume in the pressurizing chamber 73 side of the damper piston 81 in the damper chamber 82 caused by the movement of the damper piston 81. The amount of reduction in the volume of the pressure chamber 70 is reduced, i.e., is minimized by the movement of the damper piston 81, so that the amount of increase in the pressure of the pressure chamber 70 is limited. During the upward movement of the needle 3 away from the injection holes 21, the distance between the large diameter portion 30 of the needle 3 and the wall surface of the nozzle body 2, which defines the pressure control chamber 71 and is opposed to the large diameter portion 30, is increased. Thereby, the volume of the pressure chamber 70 is increased to reduce the pressure of the fuel in the pressure chamber 70. As a result, the damper spring 83 urges the damper piston 81 toward the pressurizing chamber 73 against the urging force of the fuel in the pressure chamber 70, so that the damper piston 81 is returned to its initial position at the time of lifting of the valve portion 32 of the needle 3 away from the valve seat 23.

Thereafter, when the electric discharge of the piezoelectric driver 91 starts, the piezoelectric driver 91 is axially contracted. In this way, the end portion of the piezoelectric driver 91, which has been urging the flange portion 52 of the pressurizing piston 5, begins to move away from the piston 50. At this time, the pressurizing piston 5 is moved by the urging force of the spring 53 toward the drive arrangement 9, i.e., is moved in the increasing direction (opposite from the decreasing direction) for increasing the volume of the pressurizing chamber 73. Therefore, the pressure of the fuel in the pressurizing chamber 73 is reduced, and the fuel flows from the first back pressure chamber 72 into the pressurizing chamber 73 through the communication passage 107. When the fuel in the pressurizing chamber 73 is depressurized, the pressure of the fuel in the pressure control chamber 71, which is communicated with the pressurizing chamber 73 through the pressure chamber communication passage 75, is reduced. At this time, the needle 3 is moved toward the valve seat 23 by the urging force of the spring 33, so that the valve portion 32 of the needle 3 is seated against the valve seat 23. Therefore, the communication between the fuel well 102 and the fuel chamber 101 is disconnected, and thereby the fuel injection from the injection holes 21 is terminated.

Figure 3:
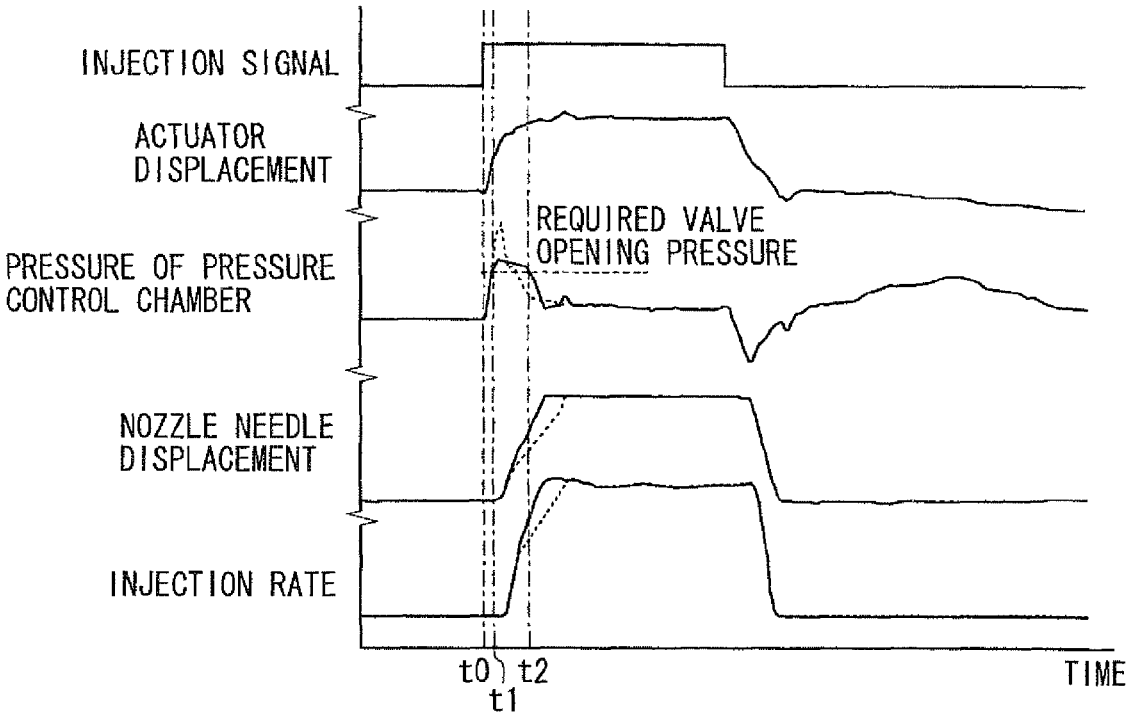
FIG. 3 is a diagram showing an operation of the fuel injection apparatus of the first embodiment in contrast to an operation of a previously proposed fuel injection apparatus.

The above-described behaviors of the main constituent parts of the fuel injection apparatus 1 are depicted in the time chart shown in FIG. 3. In FIG. 3, the solid lines indicate the behaviors of the fuel injection apparatus 1 of the first embodiment. Furthermore, in FIG. 3, dotted lines indicate the corresponding behaviors of the previously proposed fuel injection apparatus (the type in which the valve is opened by the pressurization), which is similar to the fuel injection apparatus 1 of the first embodiment except that the damper passage 108 and the damper arrangement 8 are removed from the fuel injection apparatus 1.

In the case of FIG. 3, the energization of the piezoelectric driver 91 is started at the time t0, at which the injection single is supplied to the drive arrangement 9, which has the function of the actuator that controls the injection timing and the injection quantity of the fuel by the fuel injection apparatus 1. Thus, the pressure chamber 70 is pressurized by the pressurizing piston 5, which is driven by the piezoelectric driver 91 (see the actuator displacement, which is the amount of displacement of the piezoelectric driver 91, in FIG. 3), so that the pressure in the pressure control chamber 71 reaches a required valve opening pressure, which is the minimum pressure required to lift the needle 3 away from the valve seat 23, at the time t1. Therefore, the needle 3 is lifted away from the valve seat 23 to open the injection holes 21 to inject the fuel from the injection holes 21. Normally, the fuel injection is maintained as long as the injection signal is supplied. Thereafter, when the injection signal, which is supplied to the driver arrangement (serving as the actuator) 9, is stopped, the electric discharge of the piezoelectric driver 91 begins. Therefore, the pressure of the pressure chamber 70 is temporarily reduced in comparison to the pressure of the fuel supplied from the flow inlet 22, and the needle 3 is displaced. As a result, the injection holes 21 are closed with the valve portion 32 of the needle 3 to terminate the fuel injection. After the termination of the fuel injection from the injection holes 21, the pressure chamber 70 receives the fuel supplied from the accumulator 4 to the fuel passage 100. Therefore, the pressure in the pressure chamber 70, which has been temporarily reduced, is returned to the pressure before the opening of the injection holes 21.

During the above operation, at the time t2, at which the needle 3 is lifted away from the valve seat 23, the pressure of the pressure control chamber, which is the pressure difference between the pressure chamber 70 and the supply pressure space 40, is reduced from the required valve opening pressure in the case of the previously proposed fuel injection apparatus, so that the speed of the displacement of the needle 3 (see the nozzle needle displacement, which is the amount of displacement of the needle 3, in FIG. 3) relative to the nozzle body 2 at the time t2 is reduced, and thereby the increase rate of the injection quantity of the fuel is also reduced. As a result, the time, which is required for the injection quantity of fuel per unit time (injection rate) to reach a desired quantity, is lengthened. Thereby, it is difficult to control the injection quantity of fuel in consistent with the injection signal supplied to the drive arrangement 9, so that the good response cannot be achieved. The reason why the operational response is delayed in the previously proposed fuel injection apparatus having no damper arrangement 8 is as follows. That is, the amount of change in the volume of the pressure chamber 70 from the time t1 to the time t2 is large, so that the large pressure change occurs in the pressure chamber 70. In view of the above point, in the fuel injection apparatus 1 of the first embodiment, the damper arrangement 8 is provided to temporarily increase the volume of the pressure chamber 70 through use of the damper piston 81 in response to the pressure change in the pressure chamber 70, and then the volume of the pressure chamber 70 is reduced once again through use of the damper piston 81 in response to the increase in the volume of the pressure chamber 70 caused by the lifting of the needle 3. Thereby, the amount of change in the volume of the pressure chamber 70 from the time t1 to the time t2 is limited to the small amount. Thus, as clearly indicated with the solid line in FIG. 3, the amount of change in the pressure of the control chamber is limited to the small amount, and this pressure of the control chamber is kept larger than the required valve opening pressure from the time t1 to the time t2.

In this way, according to the present embodiment, the pressure change in the pressure chamber 70 is reduced to limit the reduction in the lifting speed of the needle 3. Thus, the injection quantity of fuel per unit time can be quickly increased to the desired quantity, so that the injection quantity of fuel can be controlled in consistent with the supplied injection signal. Thereby, the fuel injection can be controlled with the stable operational response. As a result, particularly it is possible to avoid the deterioration in the atomization of the fuel at the beginning of the fuel injection during the valve opening period, so that the emissions of the internal combustion engine can be reduced, and the combustion efficiency of the fuel can be improved to improve the fuel consumption.

Second Embodiment

Figure 4:
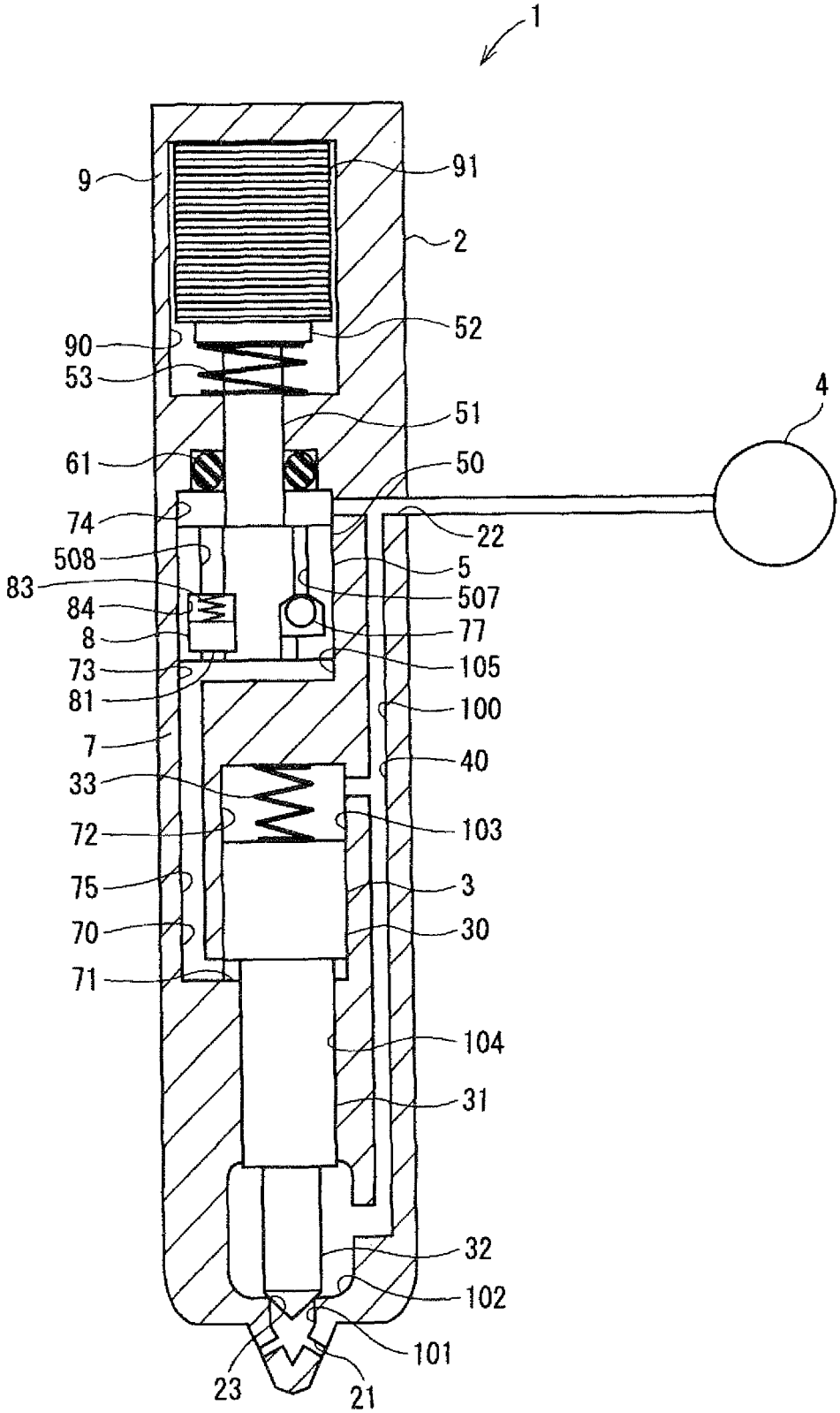
FIG. 4 is a longitudinal cross-sectional view of a fuel injection apparatus according to a second embodiment of the present invention.

A fuel injection apparatus according to a second embodiment of the present invention will be described with reference to FIG. 4. In the following description, components, which are similar to those of the first embodiment, will be indicated by the same reference numerals and will not be described further.

In the second embodiment, a communication passage 507 (communicating between the pressure chamber 70 and the supply pressure space 40) and a damper passage 508, which respectively correspond to the communication passage 107 and the damper passage 108 of the first embodiment, are provided in the interior of the pressurizing piston 5. Specifically, the communication passage 507 and the damper passage 508 are formed in the inner wall of the piston 50 to communicate between the pressurizing chamber 73 and the second back pressure chamber 74. The check valve 77 is provided in the communication passage 507 to limit the leakage of the fuel, which is pressurized in the pressurizing chamber 73, to the second back pressure chamber 74. The damper arrangement 8, which is provided in the damper passage 508, is constructed as follows. That is, the damper piston 81, and the damper spring 83 are received in the piston chamber 84, which is formed in the inner wall of the piston 50, and the damper spring 83 urges the damper piston 81 from the second back pressure chamber 74 side toward the pressurizing chamber 73 side. As discussed above, the passages, in which the check valve 77 and the damper arrangement 8 are respectively provided, may be formed in the component other than the nozzle body 2 as the passages, which communicate between the supply pressure space 40 and the pressure chamber 70.

Third and Fourth Embodiments

Figure 5:
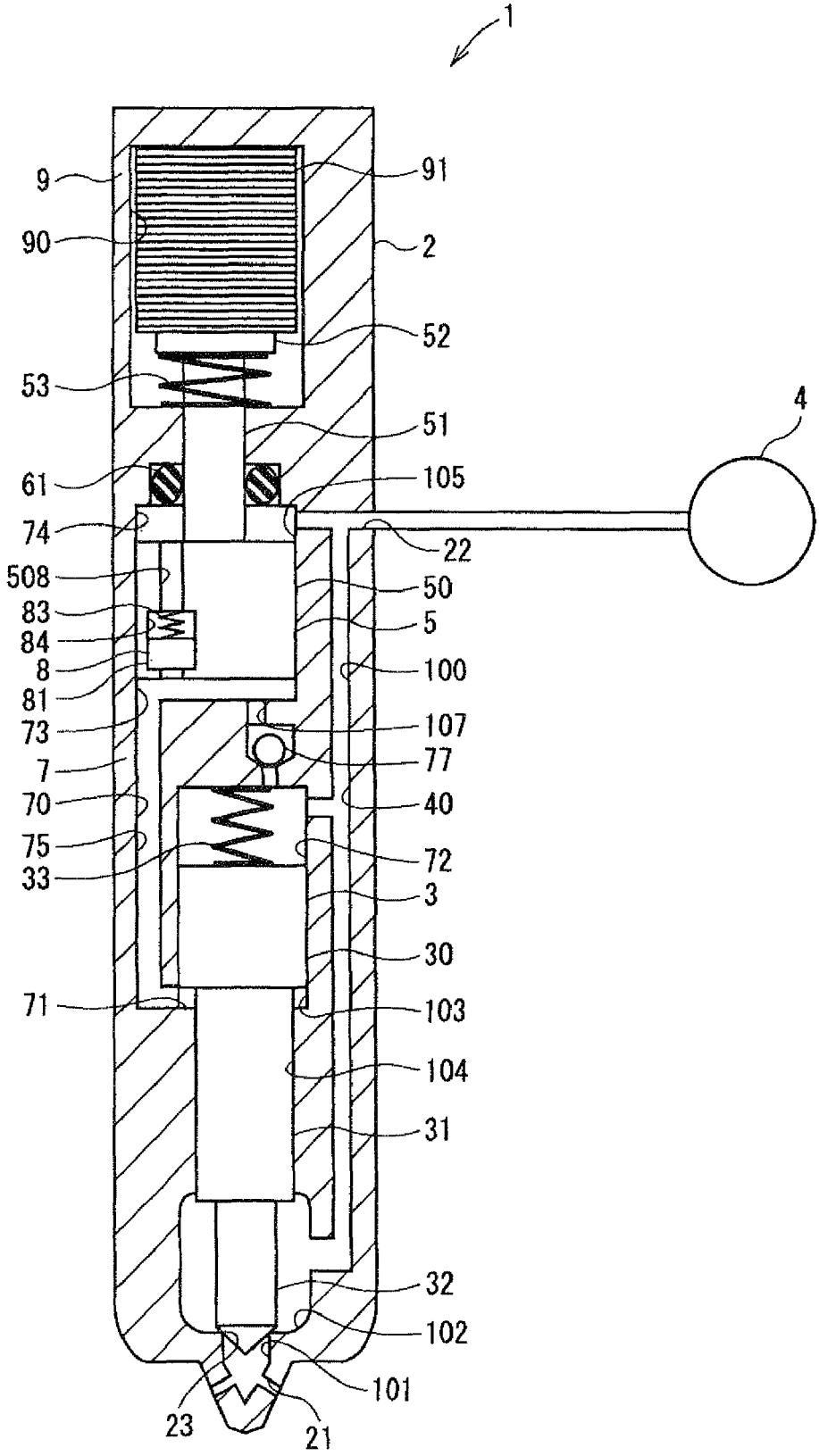
FIG. 5 is a longitudinal cross-sectional view of a fuel injection apparatus according to a third embodiment of the present invention.
Figure 6:
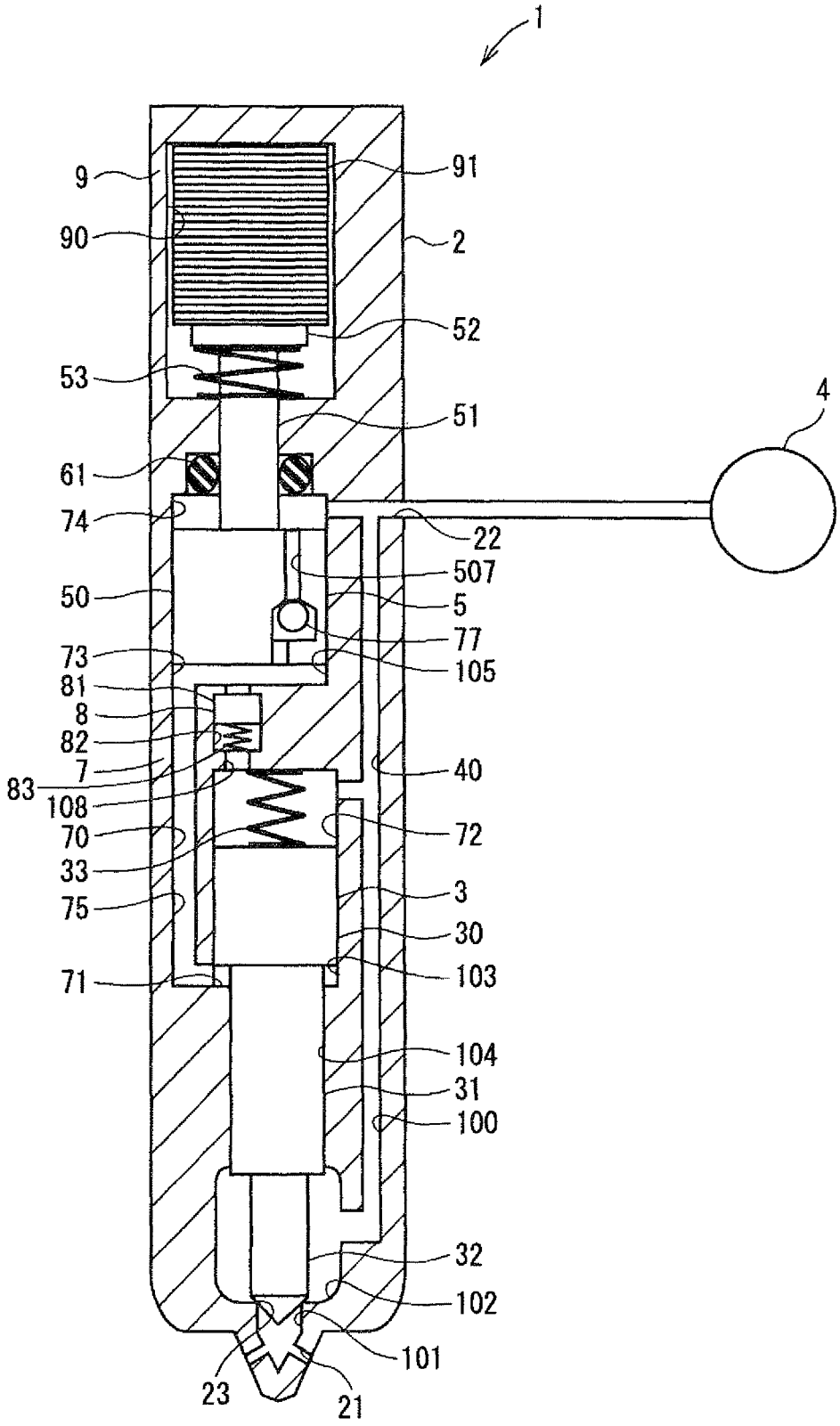
FIG. 6 is a longitudinal cross-sectional view of a fuel injection apparatus according to a fourth embodiment of the present invention.

As modifications of the second embodiment, there are provided third and fourth embodiments respectively shown in FIGS. 5 and 6. In the following description, components, which are similar to those of the first and/or second embodiments, will be indicated by the same reference numerals and will not be described further.

In the fuel injection apparatus of the third embodiment shown in FIG. 5, the damper passage 508 is provided in the piston 50, and the communication passage 107 is formed in the nozzle body 2. Furthermore, the damper arrangement 8, which has the structure substantially the same as that of the second embodiment, is provided in the damper passage 508. Also, the check valve 77 is provided in the communication passage 107 in a manner similar to that of the first embodiment.

Furthermore, in the fuel injection apparatus of the fourth embodiment shown in FIG. 6, the damper passage 108 is formed in the nozzle body 2, and the communication passage 507 is formed in the piston 50. The damper arrangement 8, which has the structure substantially the same as that of the first embodiment, is provided in the damper passage 108. Also, the check valve 77 is provided in the communication passage 507 in a manner similar to that of the second embodiment.

Now, modifications of the above embodiments will be described.

As discussed in the above embodiments, the locations of the damper arrangement 8 and of the check valve 77 can be at any appropriate locations as long as the damper arrangement 8 and the check valve 77 are respectively provided in the corresponding passages, which communicate between the pressure chamber 70 and the supply pressure space 40. Besides the above-described structures, the needle 3 may have at least one passage, which communicates between the pressure chamber 70 and the supply pressure space 40 and receives at least one of the damper arrangement 8 and the check valve 77.

Furthermore, the structure of the damper is not limited to the one, which is provided in the piston having the passage that communicates between the pressure chamber and the space communicated with the fuel passage. That is, as long as the damper can alleviate the pressure change in the pressure chamber, the structure of the damper can be any one. Particularly, the damper is desirably constructed to adjust the volume of the pressure chamber. For example, a space, which is communicated with a passage that is connected to the pressure chamber, may be provided, and there may be provided an arrangement that expands and contracts to increase and decrease a volume of this space.

Furthermore, in the above embodiments, the fuel injection apparatus is applied to the diesel engine of the common rail type. Alternatively, the fuel injection apparatus of the above embodiments may be applied to a diesel engine of any other appropriate type or a gasoline engine.

Furthermore, in the above embodiments, the pressurizing piston is used as the pressurizing means, and this pressurizing piston is driven by the piezoelectric driver. Alternatively, in place of the piezoelectric driver, it is possible to use another type of electrostrictive element, a magnetostrictive element or a linear solenoid, at which the amount of displacement changes in response to the amount of electric power supply thereto. Also, as long as it is possible to pressurize the fuel in the pressure chamber, another pressurizing means may be used in place of the pressurizing piston.

Additional advantages and modifications will readily occur to those skilled in the art. The invention in its broader terms is therefore not limited to the specific details, representative apparatus, and illustrative examples shown and described.

What is claimed is:

1. A fuel injection apparatus comprising:

a nozzle body that includes a fuel passage, to which fuel is supplied from an external fuel source, and an injection hole, which is located on a downstream side of the fuel passage and is adapted to inject the fuel outside of the nozzle body;

a needle that is received in the nozzle body and is adapted to reciprocate relative to the injection hole in a reciprocating direction to open and close the injection hole;

a first urging member that has one end, which is installed to an inner wall of the nozzle body, and the other end, which urges the needle in a closing direction toward the injection hole;

a pressure control arrangement that includes:

a pressure chamber, which receives the fuel and exerts a pressure against the needle in an opening direction away from the injection hole against an urging force of the first urging member upon increasing of the pressure of the fuel in the pressure chamber; and a damper, which is actuated upon increasing of the pressure in the pressure chamber to increase a volume of the pressure chamber;

a pressurizing piston that is received in the nozzle body and is adapted to reciprocate in the nozzle body to increase and decrease the pressure in the pressure chamber;

a second urging member that urges the pressurizing piston in a decreasing direction to decrease the pressure of the pressure chamber; and a piezoelectric driver that has one end fixed to the nozzle body and is extendable in response to an amount of electric power supply to the piezoelectric driver to urge the pressurizing piston against an urging force of the second urging member in an increasing direction, which is opposite from the decreasing direction, to increase the pressure of the pressure chamber, wherein:

the needle has a large diameter potion, which is slidable along an inner wall of the nozzle body;

the pressure control arrangement further includes a back pressure chamber that is located on one side of the large diameter portion, which is opposite from the pressure chamber in the reciprocating direction of the needle;

the back pressure chamber is communicated with the fuel passage; and the back pressure chamber exerts a pressure against the needle in a closing direction toward the injection hole upon increasing of a pressure of the fuel in the back pressure chamber.

2. The fuel injection apparatus according to claim 1, wherein the damper is provided in a damper passage, which is connected to the pressure chamber.

3. The fuel injection apparatus according to claim 1, wherein:

the damper is provided in a damper passage, which communicates between the pressure chamber and the fuel passage; and the damper includes a piston that is slidably received in the damper passage to increase a volume of the pressure chamber when a pressure difference between the pressure chamber and the back pressure chamber is increased equal to or higher than a predetermined value.

* * * * *